US006840421B2

(12) United States Patent
Urlaub et al.

(10) Patent No.: US 6,840,421 B2
(45) Date of Patent: Jan. 11, 2005

(54) TEARING TOOL

(75) Inventors: Kevin J. Urlaub, Boise, ID (US); Daiquiri Rose Fouch, Boise, ID (US); Frederic Adam Ornellas, Boise, ID (US); Eric L Ames, Boise, ID (US)

(73) Assignee: Hewlett-Packard Development Company, LP., Houston, TX (US)

( * ) Notice: Subject to any disclaimer, the term of this patent is extended or adjusted under 35 U.S.C. 154(b) by 130 days.

(21) Appl. No.: 10/007,919

(22) Filed: Dec. 7, 2001

(65) Prior Publication Data

US 2003/0106921 A1 Jun. 12, 2003

(51) Int. Cl.[7] ..... B26F 3/02; B41J 11/70

(52) U.S. Cl. ..... 225/28; 83/206; 83/277; 400/621

(58) Field of Search ..... 225/28, 21, 100, 225/101, 23, 24, 106; 83/206, 277; 271/85; D18/4.1, 54.1; 400/621, 613, 584

(56) References Cited

U.S. PATENT DOCUMENTS

| | | | | | |
|---|---|---|---|---|---|
| 1,961,271 | A | * | 6/1934 | Williams | 225/28 |
| 2,073,702 | A | * | 3/1937 | MacDonald | 225/28 |
| 3,729,190 | A | * | 4/1973 | Harris et al. | 271/85 |
| 3,891,204 | A | * | 6/1975 | Mager | 271/85 |
| 3,951,400 | A | * | 4/1976 | Blessing et al. | 414/751.1 |
| 3,952,850 | A | * | 4/1976 | Andersson et al. | 194/218 |
| 4,624,455 | A | * | 11/1986 | Radek et al. | 271/85 |
| 4,632,444 | A | * | 12/1986 | Martinez et al. | 294/86.4 |
| 4,634,107 | A | * | 1/1987 | Vandersyde et al. | 271/85 |
| 4,720,130 | A | * | 1/1988 | Andou | 294/64.1 |
| 4,874,194 | A | | 10/1989 | Borcea et al. | |
| 5,407,115 | A | * | 4/1995 | Blalock et al. | 222/30 |
| 6,203,084 | B1 | * | 3/2001 | Kruk et al. | 294/104 |
| 6,318,917 | B1 | * | 11/2001 | Taylor | 400/621 |
| 6,487,966 | B2 | * | 12/2002 | Bergomi | 271/85 |
| 6,590,387 | B2 | * | 7/2003 | Miller | 73/597 |
| 6,631,898 | B2 | * | 10/2003 | Dobrindt | 271/85 |

* cited by examiner

*Primary Examiner*—Allan N. Shoap
*Assistant Examiner*—Jason Prone

(57) ABSTRACT

A tool is provided that has a grasper adapted to selectively grasp a tearable medium, a conveyer adapted to selectively move the grasper along an axis to move the tearable medium against a tear-off edge to sever the tearable medium, and a controller adapted to transmit a first signal for instructing the conveyer to move the grasper and a second signal for instructing the grasper to grasp the tearable medium.

28 Claims, 9 Drawing Sheets

TEARING TOOL

TECHNICAL FIELD

The present invention relates generally to the field of tools and, in particular, to an automated tearing tool.

BACKGROUND

Many printers, e.g., receipt printers, print data images on a paper tape. The paper tape advances from the printer as the data images, e.g., in form of a receipt, are printed. The paper tape stops advancing when printing is completed. One common type of printer includes a roll of paper tape that unrolls during printing. After the paper stops, an individual, e.g., a sales clerk, tears off a segment of the paper tape bearing the printed images, e.g., a receipt, by pulling the tape against a tear-off edge that forms a part of the printer.

As segments of the paper tape are repeatedly torn off, the tear-off edge begins to wear, and eventually the tear-off edge fails to tear the paper tape. Therefore, it is often desirable to relate the number of segments of the paper tape torn off to the wear of the tear-off edge. This typically involves an individual tearing each of a large number of segments off by hand. One problem with hand tearing the segments is that hand tearing is costly in that hand tearing involves many hours that can conceivably be spent doing other tasks perceived as being more productive.

Some of these printers use ink-jet cartridges to deposit data images on the paper tape. Ink-jet cartridges typically have a number of flow passages for producing a number of ink jets. As each segment of the paper tape is torn off, paper particles are given off. In many instances, a portion of these particles lodge in one or more of the flow passages, clogging the passage(s). Therefore, it is often desirable to obtain information about the paper particle sizes and shapes generated from tearing segments of paper tapes of various compositions. This again typically involves an individual tearing each of a large number of segments off by hand and includes the above-mentioned problems associated with hand tearing.

For the reasons stated above, and for other reasons stated below which will become apparent to those skilled in the art upon reading and understanding the present specification, there is a need in the art for an automated tearing tool.

SUMMARY

The above-mentioned problems with hand tearing and other problems are addressed by embodiments of the present invention and will be understood by reading and studying the following specification. Embodiments of the present invention provide tearing tools for automatically tearing a tearable medium, e.g., paper tape. The tearing tools provided facilitate a reduction in cost associated with testing for printer tear-off edge wear and generation of particles of the tearable medium caused by tearing the tearable medium at the tear-off edge by eliminating hand tearing of the tearable medium during testing.

More particularly, in one embodiment, a tool is provided that has a grasper adapted to selectively grasp a tearable medium, a conveyer adapted to selectively move the grasper along an axis to move the tearable medium against a tear-off edge to sever the tearable medium, and a controller adapted to transmit a first signal for instructing the conveyer to move the grasper and a second signal for instructing the grasper to grasp the tearable medium.

Other embodiments are described and claimed.

DETAILED DESCRIPTION

Figure 1:
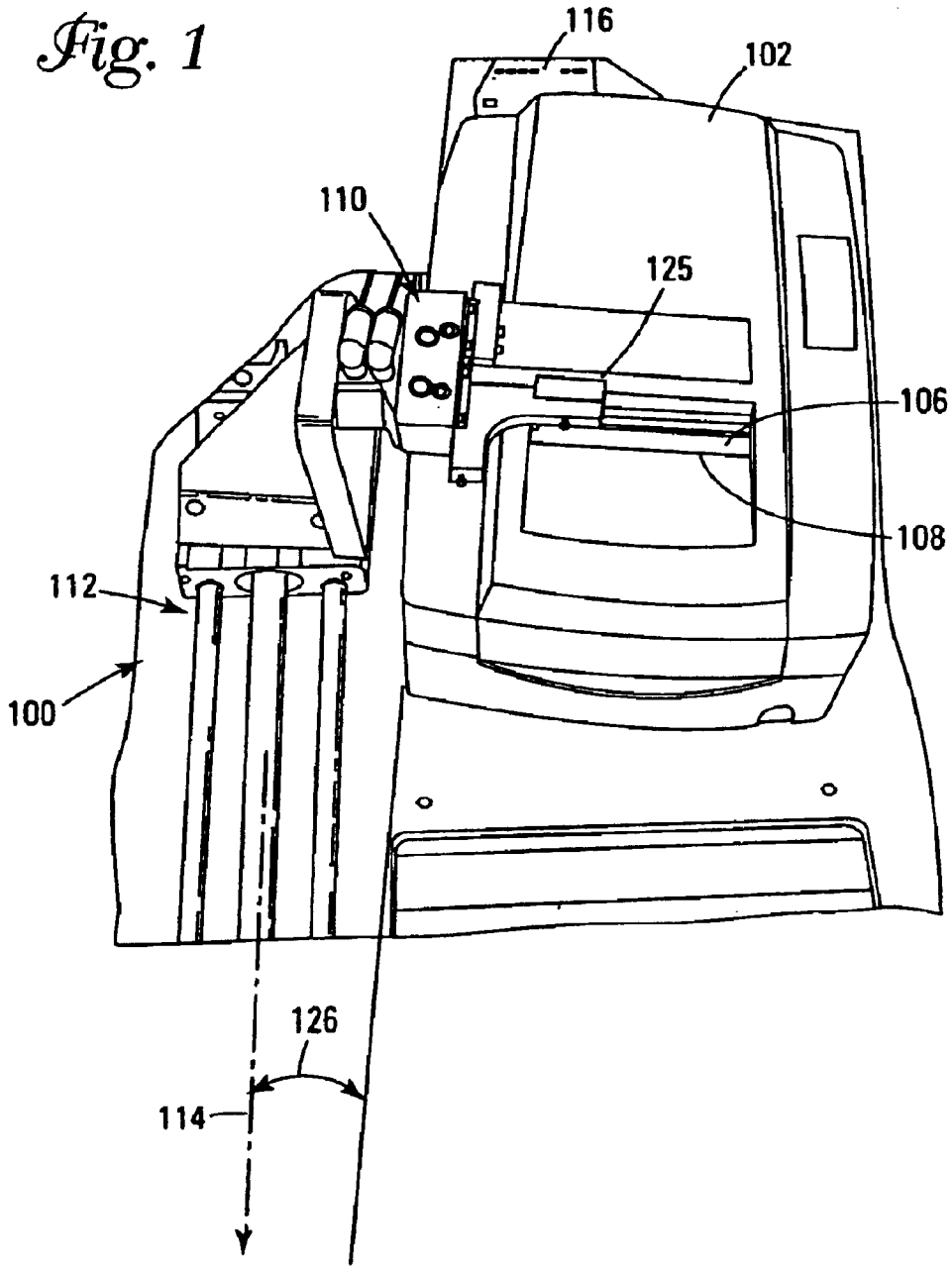
FIG. 1 is an overall view showing an embodiment of a tool positioned adjacent a printer according to the teachings of the present invention.
Figure 2:
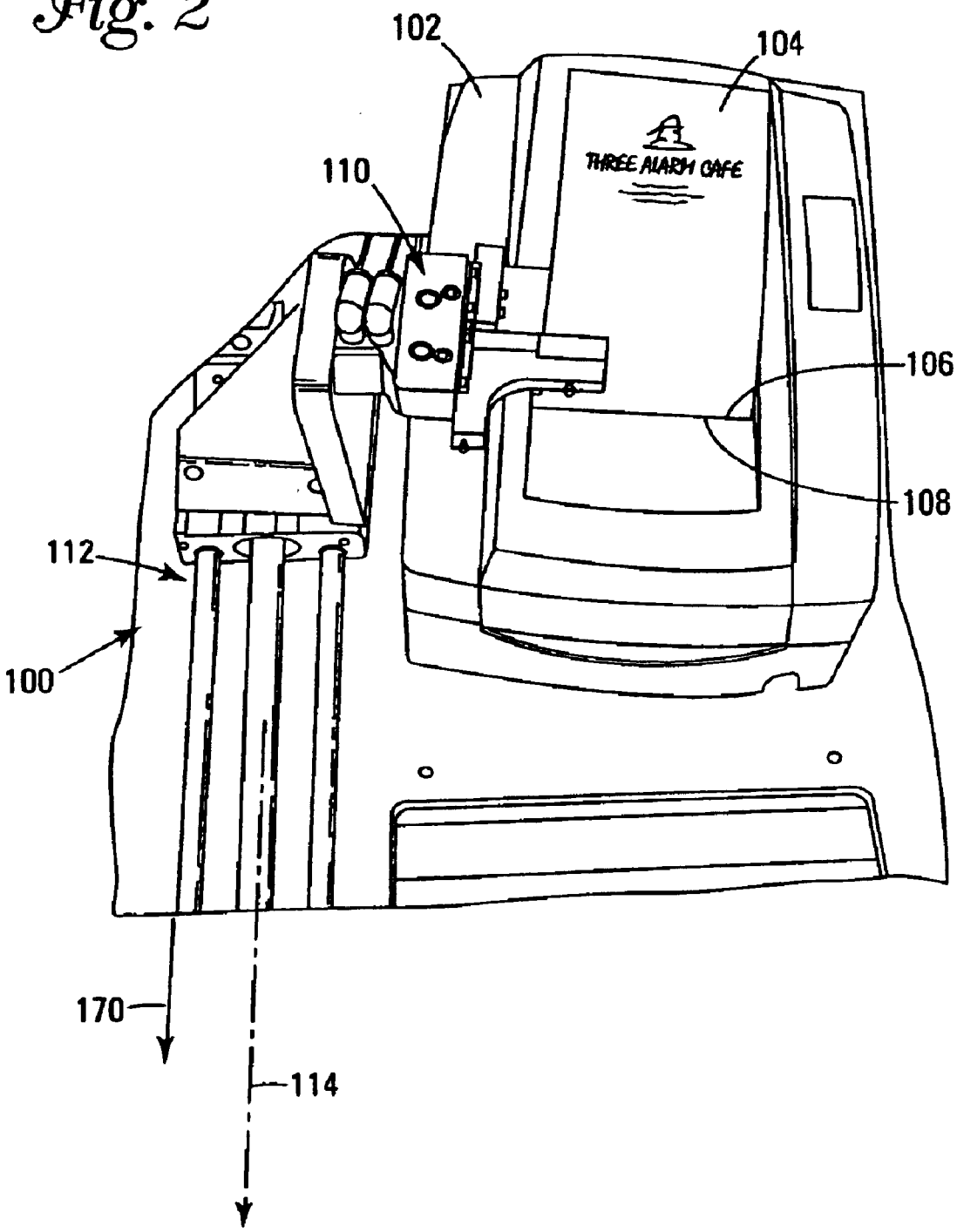
FIG. 2 is an overall view showing the tool of FIG. 1 receiving a paper tape from the printer of FIG. 1 according to the teachings of the present invention.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

FIGS. 1–9 show various embodiments of aspects of a tool 100 according to the teachings of the present invention. Tool 100 is positioned adjacent a printer 102 (e.g., the POSIJET 1000 manufactured by Ithaca TransAct Technologies, Ithaca, N.Y., USA), as shown in FIGS. 1–4. Printer 102 deposits data images on a tearable medium, such as paper tape 104 (shown in FIG. 2), e.g., the type on which receipts are printed. As data is printed on paper tape 104, paper tape 104 advances and passes through a slot 106 in printer 102. Printer 102 includes a tear-off edge 108 over which paper tape 104 is severed after a desired amount of data has been printed on paper tape 104.

Figure 3:
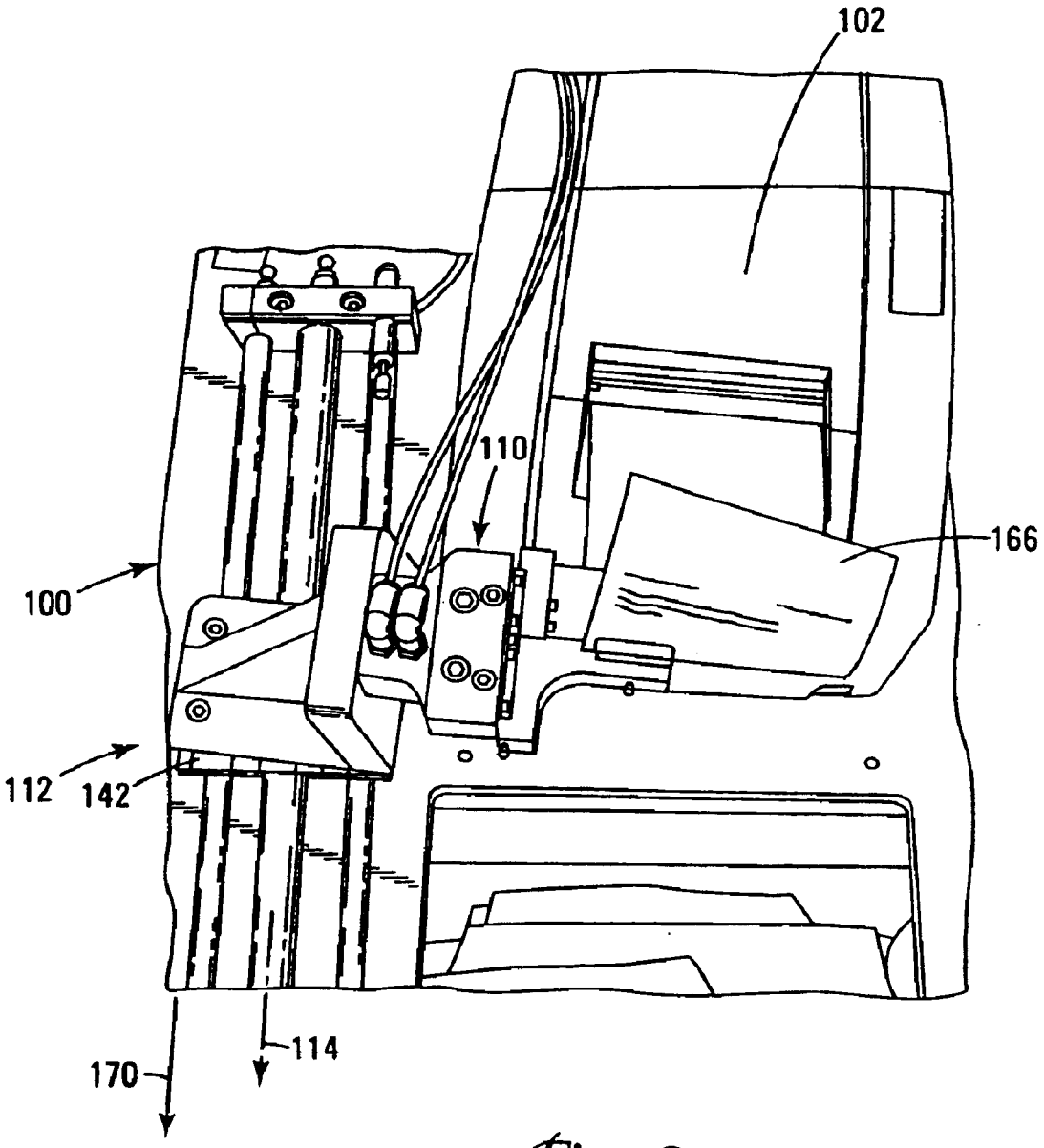
FIG. 3 is an overall view showing the tool of FIG. 1 grasping a segment of the paper tape of FIG. 2 after the paper tape is severed according to the teachings of the present invention.
Figure 4:
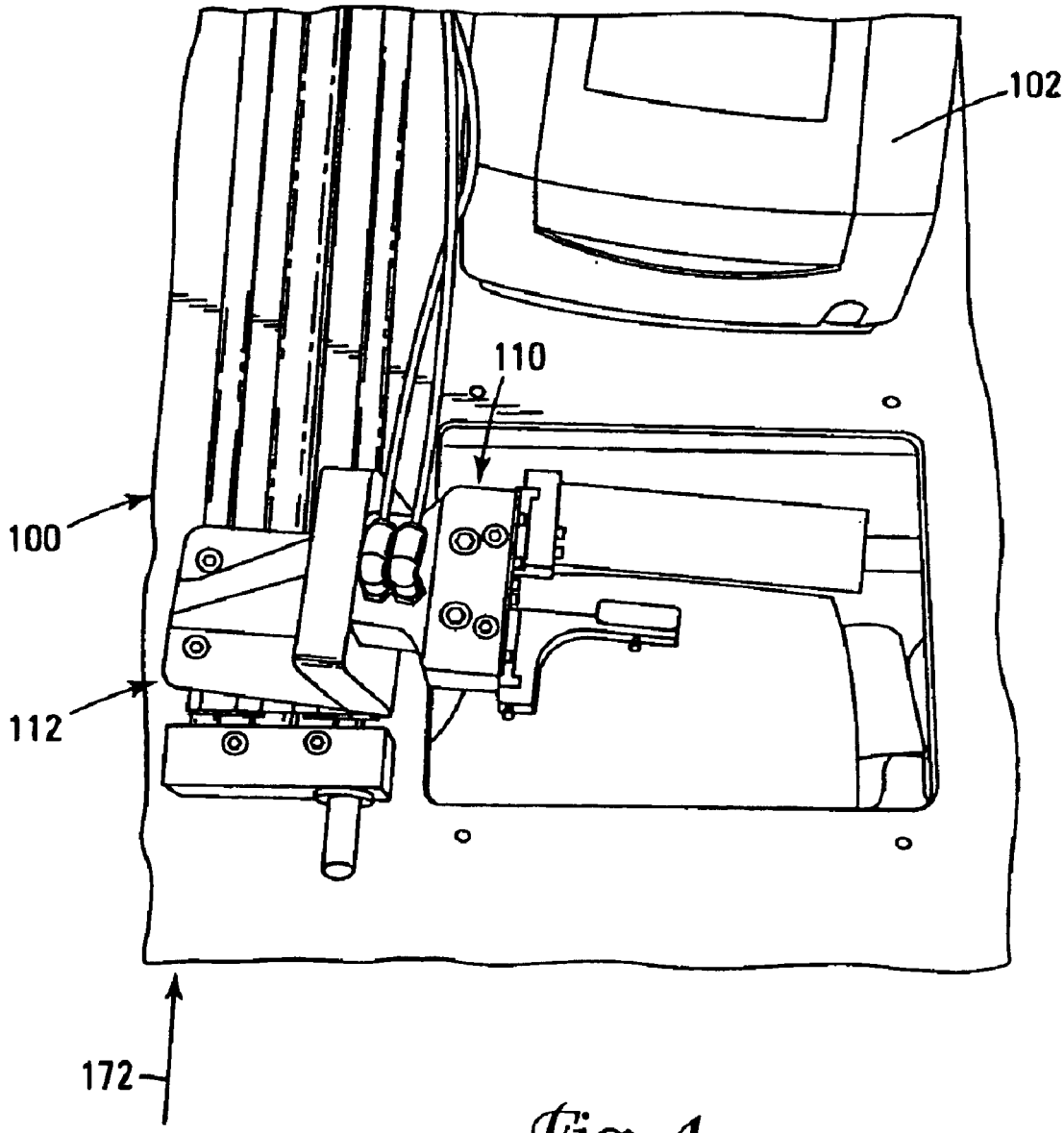
FIG. 4 is an overall view showing the tool of FIG. 1 after releasing the segment of paper tape of FIG. 3 according to the teachings of the present invention.
Figure 6:
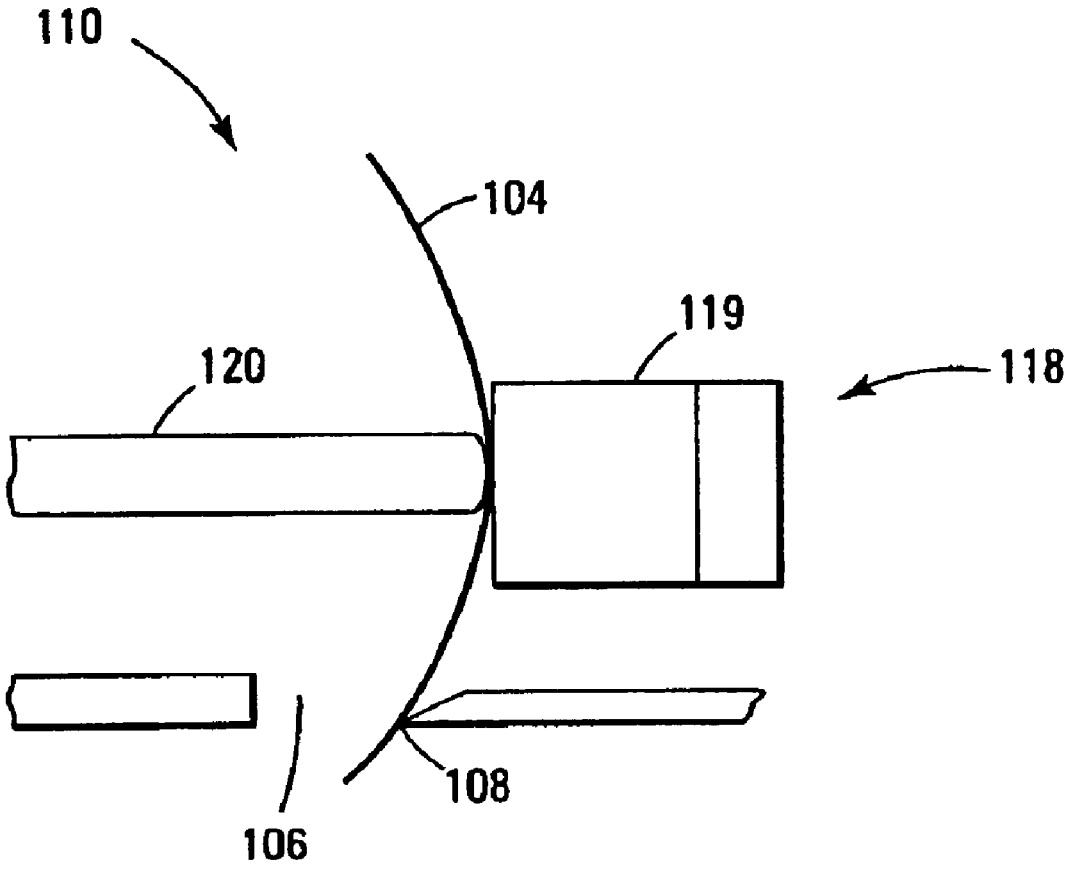
FIG. 6 is a side view showing the grasper of FIG. 5 grasping the paper tape according to the teachings of the present invention.

Tool 100 includes a grasper 110 adapted to selectively grasp paper tape 104, as shown in FIGS. 3 and 6. A conveyer 112, such as the NCDYS15H-0800b available from SMC Corporation, Tokyo, Japan, is attached to grasper 110. Conveyer 112 is adapted to selectively move grasper 110 along an axis 114 to move paper tape 104 against tear-off edge 108 to sever paper tape 104, as shown in FIG. 6. A controller 116, such as a programmable logic device (e.g., the KV-10R available from Keyence Corporation, Osaka, Japan), is adapted to transmit a first signal for instructing conveyer 112 to move grasper 110 and to transmit a second signal for instructing grasper 110 to grasp paper tape 104.

Figure 5:
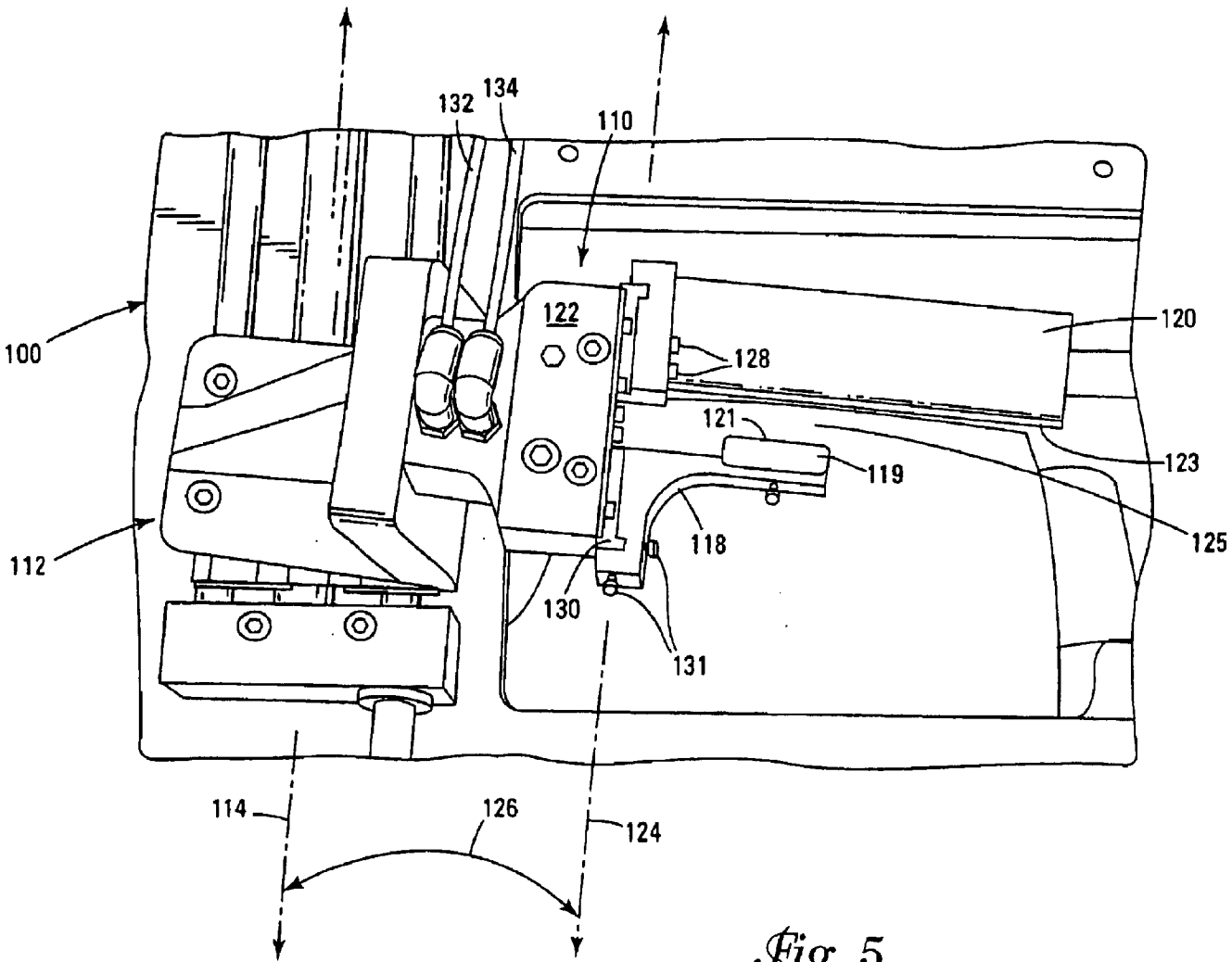
FIG. 5 is an enlarged view of an embodiment of a grasper of the tool of FIG. 1.

FIG. 5 is an enlarged view of grasper 110. Grasper 110 includes jaws 118 and 120 adapted to grasp paper tape 104 therebetween, as shown in FIGS. 3 and 6. Jaw 118 includes a pad 119 for frictionally engaging paper tape 104 along a surface 121 of pad 119. In one embodiment, pad 119 is fabricated from polyurethane, rubber, or the like. When jaws 118 and 120 grasp paper tape 108, jaw 120 engages paper tape 108 along a surface 123 of jaw 120. Jaws 118 and 120 are oriented so that their respective surfaces 121 and 123 are approximately parallel to tear-off edge 108. Therefore, when jaws 118 and 120 are open, a space 125, shown in FIGS. 1, 5, and 7, that separates jaws 118 and 120 is approximately parallel with slot 106 of printer 102. In one embodiment, each of jaws 118 and 120 are fabricated from metal, such as aluminum, steel, or the like.

Grasper 110 also includes an actuator 122 (e.g., PARALLEL GRIPPER RP-50P available from Roboband, Inc., Monroe, Conn., USA) for moving jaw 118 along an axis 124 that is approximately perpendicular to tear-off edge 108. Therefore, actuator 122 moves jaw 118 approximately perpendicularly to tear-off edge 108. Printer 102 is positioned at an angle 126 relative to axis 114, as shown in FIG. 1, where angle 126 ranges from approximately zero to ten degrees. In one embodiment, angle 126 ranges from approximately four to seven degrees. Actuator 122 moves jaw 118 into engagement with paper tape 104 to grasp paper tape 104 between jaws 118 and 120 and out of engagement with paper tape 104 for releasing paper tape 104 from between jaws 118 and 120. In one embodiment, screws 128, or the like, attach jaw 120 approximately perpendicularly to actuator 122 so that jaw 120 cannot move relative to actuator 122, and screws 131, or the like, secure jaw 118 to a slide 130 of actuator 122. FIG. 5 shows that slide 130 of actuator 122 is oriented at angle 126 with respect to the conveyor; that is, slide 130 moves along axis 124, which forms angle 126 with axis 114.

A fluid, such as air, supplied to actuator 122 by fluid-flow lines 132 and 134 causes slide 130 to move jaw 118 along axis 124. As best illustrated by the block diagram of FIG. 8, fluid-flow lines 132 and 134 are connected to an electromechanical valve 136, such as a solenoid valve (e.g., the NVJ5140 available from SMC Corporation, Tokyo, Japan), that is connected to a fluid supply by a fluid-flow line 138. Controller 116 is electrically connected to electromechanical valve 136 by a cable 140.

Figure 8:
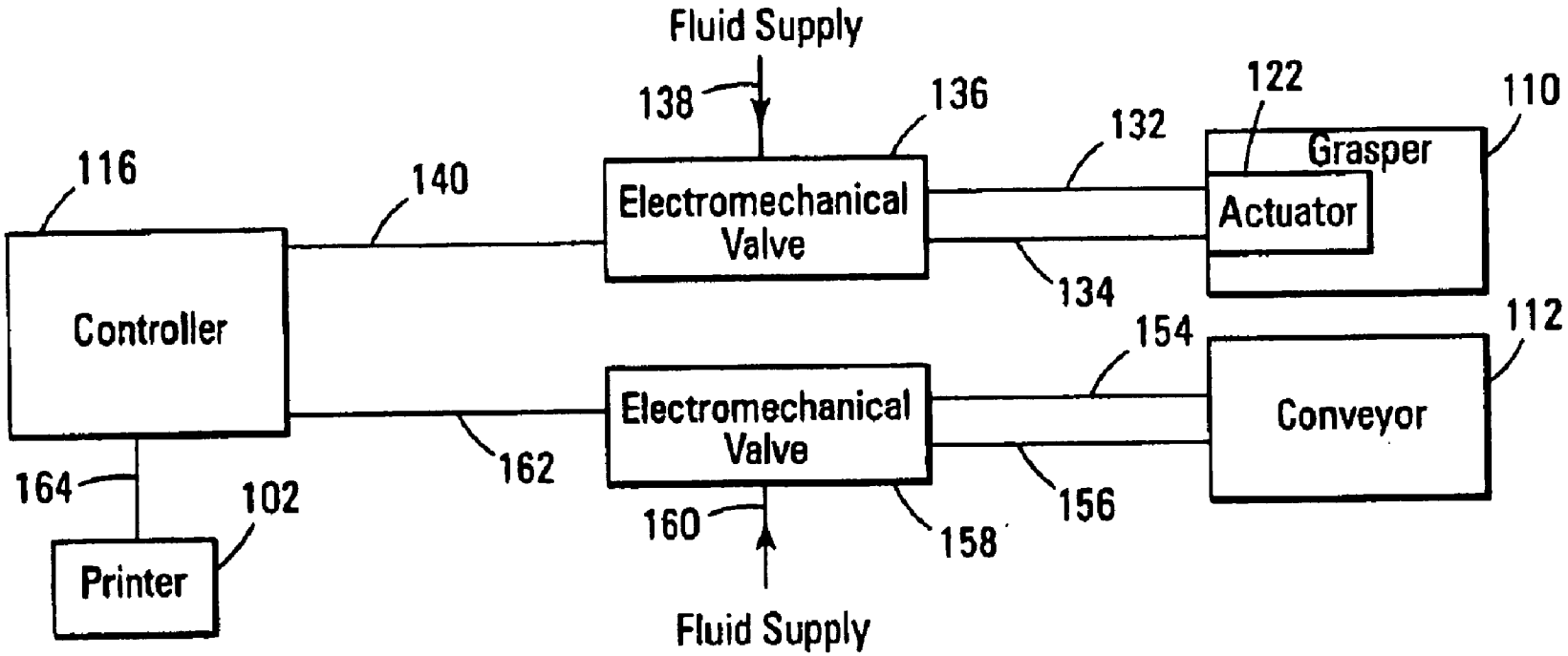
FIG. 8 is a block diagram showing embodiments of electrical and fluid circuitry according to the teachings of the present invention.
Figure 9:
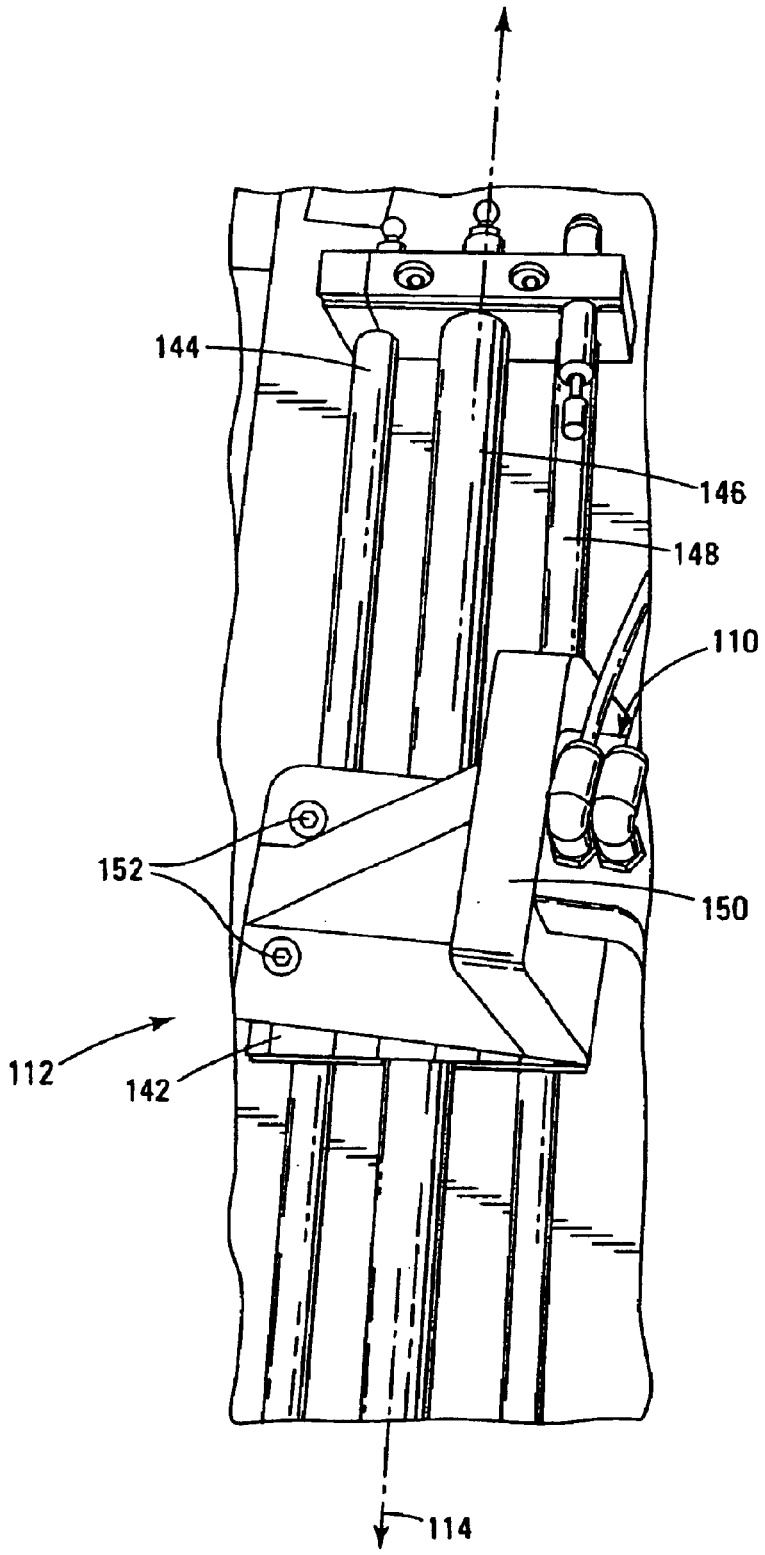
FIG. 9 is an enlarged view of an embodiment of a conveyer of the tool of FIG. 1.

FIG. 9 is an enlarged view of conveyor 112. Conveyor 112 includes a carriage 142 that slides on rails 144, 146, and 148. A bracket 150, secured to carriage 142 by screws 152 or the like, attaches grasper 110 to carriage 142. A fluid, such as air, supplied to conveyor 112 by fluid-flow lines 154 and 156, as shown in FIG. 8, causes carriage 142 to slide on rails 144,146, and 148, thereby moving grasper 110 along axis 114. FIG. 8 also shows that fluid-flow lines 154 and 156 are connected to an electromechanical valve 158, such as a solenoid valve (e.g., the NVJ5140 available from SMC Corporation, Tokyo, Japan), that is connected to a fluid supply by a fluid-flow line 160. Controller 116 is electrically connected to electromechanical valve 158 by a cable 162. Controller 116 is electrically connected to printer 102 by a cable 164.

Figure 7:
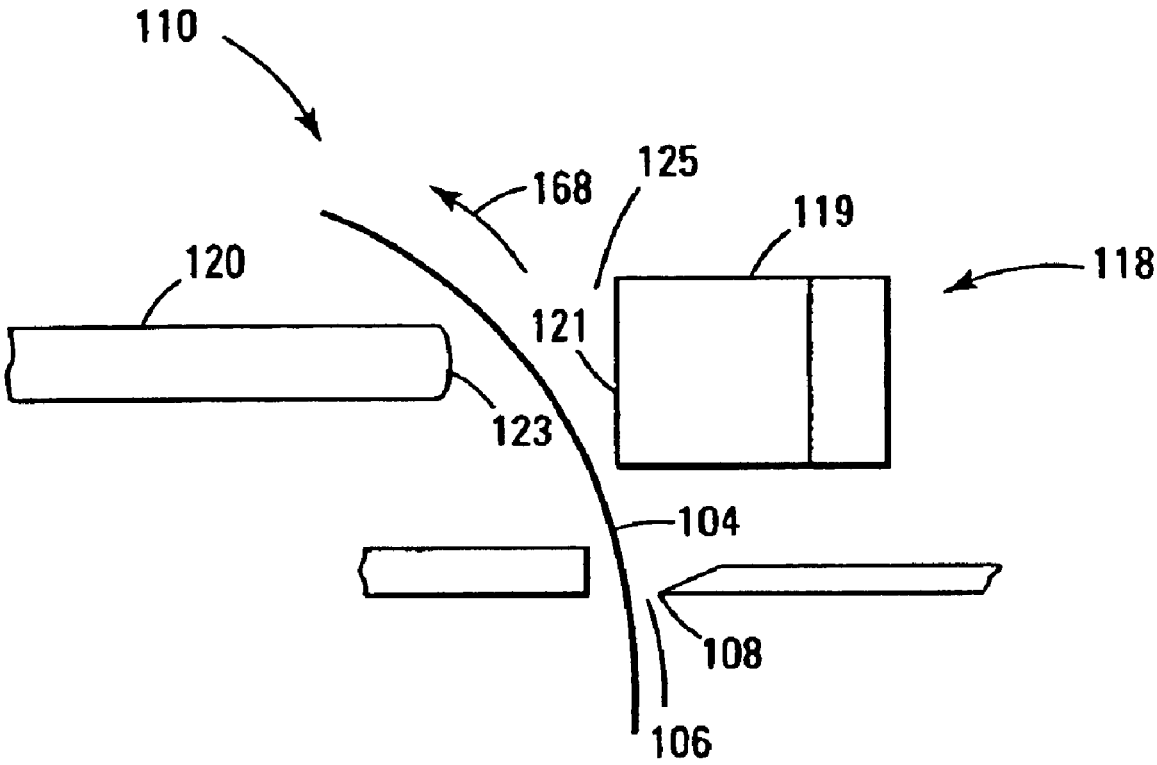
FIG. 7 is a side view showing the grasper of FIG. 5 receiving the paper tape according to the teachings of the present invention.

In operation, jaws 118 and 120 are initially open and are located above slot 106 of printer 102 in the position shown in FIG. 1. As printer 102 prints data on paper tape 104, paper tape 104 issues from slot 106 and passes through the space 125 between jaws 118 and 120 generally in the direction of arrow 168, as shown in FIG. 7. After a desired amount of data has been printed on paper tape 104, printer 102 sends a signal p1 (e.g., an "open cash drawer signal") to controller 116 via cable 162.

Upon receiving signal p1, controller 116 respectively transmits each of a sequence of signals c at each of a sequence of times t preprogrammed into controller 116. At a time t1 of the timing sequence, controller 116 transmits a signal c1 to electromechanical valve 158 via cable 164 instructing electromechanical valve 158 to allow fluid to flow from the fluid supply to conveyer 112 via fluid-flow line 160, electromechanical valve 158, and fluid-flow line 154. This causes carriage 142 of conveyer 112 to slide on rails 144, 146, and 148 to move grasper 110 along axis 114 in the direction of arrow 170 in FIG. 2.

At a time t2 of the timing sequence, controller 116 transmits a signal c2 to electromechanical valve 136 via cable 140 instructing electromechanical valve 136 to allow fluid to flow from the fluid supply to actuator 122 via fluid-flow line 138, electromechanical valve 136, and fluid-flow line 132. This causes slide 130 of actuator 122 to move jaw 118 along axis 124 and into engagement with paper tape 104 so that jaws 118 and 120 grasp paper tape 104 therebetween. Carriage 142 of conveyer 112 continues to move, pulling paper tape 104 against tear-off edge 108, as shown in FIG. 6, to sever paper tape 104. Since carriage 142 moves along axis 114, printer 102 is located at angle 126 with respect to axis 114, and jaws 118 and 120 are approximately parallel to tear-off edge 108, carriage 142 pulls paper tape 108 at angle 126 with respect to tear-off edge 108. This facilitates severing paper tape 108.

After paper tape 108 is severed, grasper 110 continues to grasp a segment 166 of paper tape 108, and carriage 142 of conveyer 112 continues to move in the direction of arrow 170, as shown in FIG. 3. At time t3 of the timing sequence, controller 116 transmits a signal c3 to electromechanical valve 136 via cable 140 instructing electromechanical valve 136 to allow fluid to flow from the fluid supply to actuator 122 via fluid-flow line 138, electromechanical valve 136, and fluid-flow line 134. This causes slide 130 of actuator 122 to move jaw 118 along axis 124 and out of engagement with paper tape 104 to release segment 166 of paper tape 108 from between jaws 118 and 120.

At time t4 of the timing sequence, controller 116 transmits a signal c4 to electromechanical valve 158 instructing electromechanical valve 158 to allow fluid to flow from the fluid supply to conveyer 112 via fluid-flow line 160, electromechanical valve 158, and fluid-flow line 156. This causes carriage 142 to move grasper 110 in the direction of arrow 172 in FIG. 4 to return grasper 110 from the position of FIG. 4 to the position of FIG. 1.

CONCLUSION

Embodiments of the present invention have been described. The embodiments provide tearing tools for automatically tearing a tearable medium, such as paper tape 104. The tearing tools provided facilitate a reduction in cost associated with testing for printer tear-off edge wear and generation of particles of the tearable medium caused by tearing the tearable medium at the tear-off edge by eliminating hand tearing of the tearable medium during testing.

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, sensors, e.g., optical, electromechanical, or the like, may be distributed along conveyer 112 for respectively transmitting signals c1–c4 to controller 116 that are respectively indicative of instantaneous positions of carriage 142.

What is claimed is:

1. A tool comprising:

a tear-off edge;

a grasper, adapted to selectively grasp a tearable medium, extending along a first axis;

a conveyor adapted to selectively move the grasper along second axis oblique to the first axis to move the tearable medium against the tear-off edge to sever the tearable medium; and a controller adapted to transmit a first signal for instructing the conveyor to move the gasper and a second signal for instructing the gasper to grasp the tearable medium.

2. The tool of claim 1, wherein the controller comprises a programmable logic device.

3. The tool of claim 1, wherein the tear-off edge constitutes a part of a printer.

4. The tool of claim 1, wherein the controller receives a signal that instructs the controller to transmit the first and second signals.

5. The tool of claim 1, wherein the conveyor comprises a carriage and at least one rail, the carriage slidably attached to the at least one rail and fixedly attached to the grasper.

6. The tool of claim 1, and further comprising a first electromechanical valve that receives the first signal from the controller, the first electromechanical valve passing a flow of fluid to the conveyor upon receiving the first signal for moving the grasper.

7. The tool of claim 6, wherein the grasper comprises first and second jaws adapted to grasp the tearable medium therebetween and further comprising a second electromechanical valve that receives the second signal, the second electromechanical valve passing a flow of fluid to the grasper upon receiving the second signal for moving the first jaw into engagement with the tearable medium.

8. The tool of claim 1, wherein the grasper comprises first and second jaws adapted to grasp the tearable medium therebetween.

9. The tool of claim 8, wherein the first jaw comprises a pad for frictionally engaging the tearable medium.

10. The tool of claim 8, wherein the grasper comprises an actuator adapted to move the first jaw into engagement with the tearable medium for grasping the tearable medium between the first and second jaws and to move the first jaw out of engagement with the tearable medium for releasing the tearable medium from between the first and second jaws.

11. The tool of claim 8, wherein the first jaw is actuatable relative to the second jaw along a third axis that forms an oblique angle with the second axis along which the conveyor moves the grasper.

12. The tool of claim 11, wherein the third axis along which the first jaw is actuatable extends perpendicular to the first axis.

13. A tool for tearing printable media from an imaging device, the tool comprising:

a conveyor;

an actuator attached to the conveyor, the actuator including:

a slide;

a first jaw fixedly attached to the actuator;

a second jaw located opposite the first jaw and slidably attached to the slide of the actuator so as to linearly move towards and away from the first jaw;

a controller connected to the conveyor and the actuator; and a tear-off edge, wherein the first jaw and the second jaw are configured to selectively grasp the printable medium and wherein the conveyor is configured to move the first jaw and the second jaw to move the printable medium against the tear-off edge, wherein the actuator is attached to the conveyor so that the slide of the actuator is oriented at an oblique angle with respect to the conveyor.

14. The tool of claim 13, wherein the second jaw comprises a pad.

15. The tool of claim 13, wherein the controller comprises a programmable logic device.

16. The tool of claim 13, and further comprising an electromechanical valve that is electrically connected to the controller and fluidly connected to the conveyor.

17. The tool of claim 13, and further comprising an electromechanical valve that is electrically connected to the controller and fluidly connected to the actuator.

18. The tool of claim 13, wherein the conveyor comprises a carriage and at least one rail, the carriage slidably attached to at least one rail and fixedly attached to the actuator.

19. A printing system comprising:

a printer configured to print upon a tearable medium;

an edge configured to extend along the tearable medium;

a grasper configured to grasp the tearable medium along a first axis while being moved in a direction oblique to the first axis to urge the tearable medium against the edge to sever the medium.

20. The system of claim 19 including an actuator configured to move the grasper between a grasping state in which the grasper grasps the tearable medium and a releasing state in which the grasper does not grasp the tearable medium.

21. The system of claim 19 including a conveyor configured to move the grasper.

22. The system of claim 21 including an actuator configured to move the grasper between a grasping state in which the grasper grasps the tearable medium and a releasing state in which the grasper does not grasp the tearable medium.

23. The system of claim 22 including a controller configured to generate control signals, wherein the conveyor moves the grasper in response to the control signals and wherein the actuator moves the grasper in response to the control signals.

24. The system of claim 19, wherein the grasper includes a first surface and a second opposite surface and wherein the first surface and the second surface are configured to engage opposite sides of the tearable medium.

25. The system of claim 24, wherein at least one of the first surface and the second surface is movable relative to the other of the first surface and the second surface to move between a grasping state and a releasing state.

26. The system of claim 25, wherein said at least one of the first surface and the second surface moves along the second axis perpendicular to the first axis.

27. A tool comprising:

a tear-off edge;

first and second jaws;

an actuator adapted to selectively move the first jaw along a first axis into engagement with a tearable medium to grasp the tearable medium between the first and second jaws and out of engagement with the tearable medium to release the tearable medium from between the first and second jaws;

a conveyor adapted to selectively move the first and second jaws along a second axis that forms an oblique angle with the first axis to move the tearable medium when grasped by the first and second jaws against the tear-off edge to sever the tearable medium; and a controller adapted to transmit a first signal for instructing the conveyor to move the grasper from a first position, and a second signal for instructing the actuator to move the first jaw into engagement with the tearable medium.

28. The tool of claim 27, wherein the tear-off edge extends along a third axis oblique to the second axis.

* * * * *